United States Patent [19]

Stark

[11] 4,217,945

[45] Aug. 19, 1980

[54] WEDGE-SHAPED SECURING ELEMENT FOR ROLLER BLIND ASSEMBLY

[75] Inventor: Gerd Stark, Bergisch Gladbach, Fed. Rep. of Germany

[73] Assignee: Dyna-Plastik Werke GmbH, Bergisch-Gladbach, Fed. Rep. of Germany

[21] Appl. No.: 971,637

[22] Filed: Dec. 20, 1978

[30] Foreign Application Priority Data

Jan. 13, 1978 [DE] Fed. Rep. of Germany ..... 2801302

[51] Int. Cl.[2] ..... E06B 3/12; E06B 9/00

[52] U.S. Cl. ..... 160/236; 160/133

[58] Field of Search ..... 160/133, 231 A, 236

[56] References Cited

U.S. PATENT DOCUMENTS

| | | | |
|---|---|---|---|
| 2,898,988 | 8/1959 | Zoll | 160/133 |
| 3,019,486 | 2/1962 | Stinson | 160/231 A |
| 3,635,278 | 1/1972 | Bocade | 160/231 A |

FOREIGN PATENT DOCUMENTS

| | | | |
|---|---|---|---|
| 1509513 | 11/1969 | Fed. Rep. of Germany | 160/133 |
| 351388 | 2/1961 | Switzerland | 160/133 |

*Primary Examiner*—Peter M. Caun

*Attorney, Agent, or Firm*—Browdy and Neimark

[57] ABSTRACT

The invention comprises a wedge-shaped element for securing a roller blind assembly to a wind-up roll, wherein it comprises a plurality of single-walled members interconnected by film hinges.

4 Claims, 2 Drawing Figures

WEDGE-SHAPED SECURING ELEMENT FOR ROLLER BLIND ASSEMBLY

Figure 1:
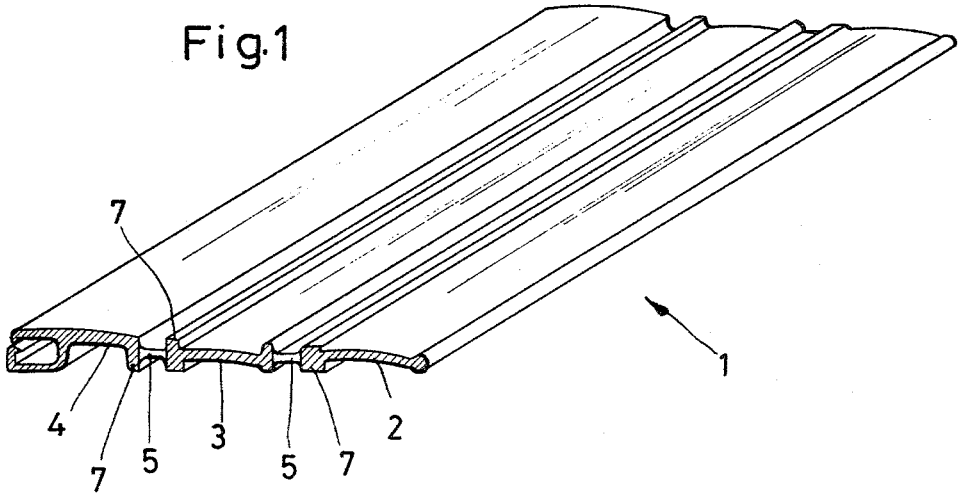

This invention relates to a wedge-shaped element according to the generic clause of claim 1.

It is known to secur a roller blind assembly to the wind-up roll by means of a simple belt strip with belt ribbons. However, the belt strip may also be directly bolted to the wind-up roll. By these securing methods, however, no precisely defined attachment of the roller blind assembly to the roll is possible.

Mainly for a subsequent building-in of roller blinds in old buildings, in many instances the roller blind must be wound closely onto a roller blind shaft of a small diameter for space requirements. Therefore, connecting elements have also already been used consisting of hollow, wedge-shaped sections, which, however, because of their multi-piece embodiment in hollow sections are very expensive in material and cost. Also, they likewise bring about no defined position on the wind-up roll.

For eliminating these deficencies, according to the invention, a wedge-shaped securing element is proposed as characterized in claim 1.

In order to permit a precisely defined position of the roller blind assembly on the wind-up roll and thus also the parallel alignment thereof relative to the longitudinal axis of the shaft in a particularly simple way, the starting member of the securing element may be conformed to the outer shape of the wind-up roll.

For saving material, the individual members of the securing element may be provided with webs the heights of which increase toward the end member. Conveniently, the webs are arranged in such a way that the roller blind sections when winding up the roller blind nest in the intermediate spaces between the webs and thus further reduce the diameter of winding.

Finally, the end member of the securing element may be conformed to the sectional shape of the roller blind rods, thereby an optical conforming to the roller blind rods and thus a saving of such rods being achieved.

The members of the securing element may preferably consist of hard polyvinylchloride, and the film hinges may consist of soft polyvinylchloride. They may of course also consist of some other suitable plastic or some other material.

In the drawing, an embodiment of the invention has been illustrated semi-diagrammatically.

Figure 2:
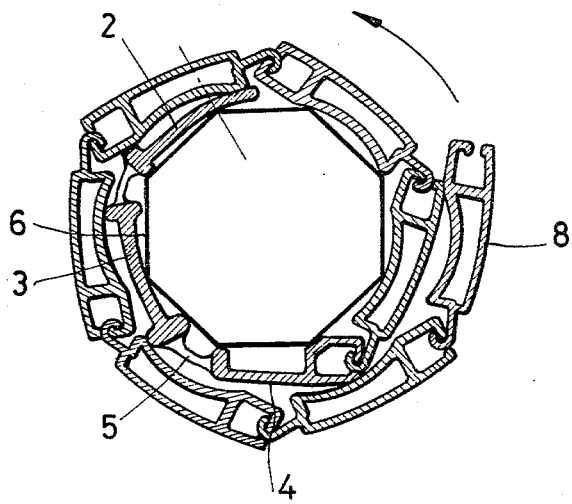

FIG. 1 shows a wedge-shaped securing element according to the invention, and FIG. 2 shows a roller blind roll equipped therewith.

In the Figures, 1 denominates the wedge-shaped securing element, which comprises members 2, 3 and 4 which are interconnected by film hinges 5. The starting member 2 of the element 1 is conformed to the outer shape of the wind-up roll 6. The members 2, 3/are provided with webs 7 the heights of /and 4 which increase toward the end member 4. The end member 4 of the element 1 is conformed to the sectional shape of the conventional roller blind rods 8.

The wedge-shaped securing element is produced in an extrusion process with a good cost benefit. It is connected like any other conventional belt strip to the roller blind assembly by being pushed in, pivotally, and thus it is ready for assembly. For assembling, the starting member 2 conformed to the outer shape of the roller blind roll 6 is applied to the roller blind roll 6 in the way illustrated in FIG. 2. The roller blind is thereby professionally aligned and may be secured by bolting or rivetting to the roller blind roll 6.

I claim:

1. In a wedge-element for connecting a roller blind assembly composed of section rods to a wind-up roll, the end of the element facing the roller blind assembly having a profile conformed to the profile of the sectional rods of the roller blind assembly, the improvement wherein said element is divided by a plurality of flexible portions defining a plurality of flexure points (5) into several members (2, 3, 4), there being present one less said flexible portion than said members, the initial member (2) of said several members being attachable to said wind-up roll (6) and being conformed to the circumferential shape of said wind-up roll (6).

2. An improved wedge-element according to claim 1, wherein the wall thickness of said members (2, 3, 4) is reduced in their central portions to define respective webs (7) adjacent said flexible portions, the height of said webs (7) increasing from said initial member (2) toward the final member (4) of said several members, said final member being connectable to said roller blind assembly.

3. An improved wedge-element according to claim 2, wherein said members (2, 3, 4) are of hard polyvinylchloride and said flexible portions are of soft polyvinylchloride.

4. An improved wedge-element according to claim 1, wherein said members (2, 3, 4) are of hard polyvinylchloride and said flexible portions are of soft polyvinylchloride.

* * * * *